US009049936B2

(12) United States Patent
Leone et al.

(10) Patent No.: US 9,049,936 B2
(45) Date of Patent: Jun. 9, 2015

(54) INTEGRAL COCCYX AND LUMBAR SUPPORT SYSTEM

(75) Inventors: Massimo Angelo Leone, Penfield, NY (US); Gary John Kieffer, Moravia, NY (US); Larry Jedik, Auburn, NY (US)

(73) Assignee: Currier Plastics, Auburn, NY (US)

( * ) Notice: Subject to any disclaimer, the term of this patent is extended or adjusted under 35 U.S.C. 154(b) by 0 days.

(21) Appl. No.: 13/006,534

(22) Filed: Jan. 14, 2011

(65) Prior Publication Data

US 2012/0181840 A1 Jul. 19, 2012

(51) Int. Cl.

| | |
|---|---|
| ***A47C 3/16*** | (2006.01) |
| ***A47C 7/46*** | (2006.01) |
| ***A47C 7/42*** | (2006.01) |
| ***A47C 3/12*** | (2006.01) |

(52) U.S. Cl.
CPC . *A47C 7/425* (2013.01); *A47C 3/12* (2013.01); *A47C 7/46* (2013.01)

(58) Field of Classification Search
USPC ..... 297/452.3–452.36, 452.23–452.26, 297/452.12, 452.14
See application file for complete search history.

(56) References Cited

U.S. PATENT DOCUMENTS

| | | | | |
|---|---|---|---|---|
| 2,745,468 | A * | 5/1956 | Kramer | 297/285 |
| 2,855,986 | A * | 10/1958 | Engelen, Sr. | 297/382 |
| 3,112,956 | A * | 12/1963 | Schick et al. | 297/219.1 |
| 3,713,696 | A * | 1/1973 | Dudley | 297/452.55 |
| 4,718,727 | A | 1/1988 | Sheppard | |
| D307,221 | S | 4/1990 | Mudge | |
| 5,033,742 | A | 7/1991 | Johnson et al. | |
| 5,251,963 | A | 10/1993 | Inayoshi et al. | |
| 5,452,940 | A * | 9/1995 | Maier | 297/452.32 |
| 5,887,951 | A | 3/1999 | Willingham | |
| 5,957,534 | A | 9/1999 | Wilkerson et al. | |
| 6,565,153 | B2 | 5/2003 | Hensel et al. | |
| 6,929,325 | B1 | 8/2005 | Goelo | |
| 7,040,706 | B2 | 5/2006 | Koffler | |
| 7,147,284 | B2 * | 12/2006 | Mills et al. | 297/271.5 |
| D659,444 | S * | 5/2012 | James | D6/500 |
| 2007/0057562 | A1 | 3/2007 | Gregory et al. | |
| 2007/0096523 | A1 * | 5/2007 | Greene, Jr. | 297/284.7 |

* cited by examiner

*Primary Examiner* — David R Dunn
*Assistant Examiner* — Timothy J Brindley
(74) *Attorney, Agent, or Firm* — Brian B. Shaw, Esq.; Timothy W. Menasco, Esq.; Harter Secrest & Emery LLP

(57) ABSTRACT

A seating support includes a lumbar support portion having first and second lumbar supports. The lumbar support portion defines at least a portion of a channel extending between the first and second lumbar supports. The channel is sized to substantially preclude contact with an occupant of the seating support. Such a seating support also includes a coccyx support portion having first and second coccyx supports. The coccyx support portion is disposed substantially perpendicular to the lumbar support portion and is in communication therewith such that the channel extends from the lumbar support portion between the first and second coccyx supports.

19 Claims, 9 Drawing Sheets

INTEGRAL COCCYX AND LUMBAR SUPPORT SYSTEM

CROSS-REFERENCE TO RELATED APPLICATIONS

None.

STATEMENT REGARDING FEDERALLY SPONSORED RESEARCH OR DEVELOPMENT

Not applicable.

REFERENCE TO A "SEQUENCE LISTING"

Not applicable.

BACKGROUND OF THE INVENTION

1. Field of the Invention

The present disclosure is related to orthopedic seating supports, and in particular, to seating supports configured to provide both coccyx and lumbar support.

2. Description of Related Art

Lower back pain can result from remaining in a seated position for extended periods of time without proper support. For example, sitting on a grass surface or on bleachers as a spectator at a sporting event may be acceptable for short periods. However, sitting on such surfaces without the use of proper support mechanisms can be painful over long periods of time. In addition, back pain may be exacerbated if such spectators participate in athletic or other strenuous activities immediately following being seated for an extended time.

To remedy this type of back pain, one may seek the attention of a chiropractor or other medical expert so that adjustments to the spine can be made. These medical professionals may assist in returning the spine to a more natural posture, and may reduce such back pain. However, it is not always possible to visit with medical professionals when pain occurs. Moreover, visiting such professionals on a repeated basis can be inconvenient and expensive. As a result, various seating support devices have been developed recently to assist users in maintaining a proper posture while seated.

Some known devices are configured to support the coccyx and/or buttocks of the user. These devices typically resemble a predominantly flat cushion on which the user may sit, and such devices may be disposed, for example, on the base of a chair, bench, bleacher seat, or other preexisting structure during use. Such devices may be made from gels, foams, soft plastics, and/or other like materials, and are relatively common. However, these devices typically do not provide adequate lumbar support for the user and may be ineffective in minimizing back pain or injury due to poor seating posture.

Other known devices may be, for example, connectable to the backrest of a chair or other like seating structure to provide lumbar support during use, but such devices may not provide adequate buttocks or coccyx support to the user. Finally, a third category of devices may provide lumbar and coccyx support, but such combined devices are generally not rigid enough to support the weight of a user and to assist the user in maintaining a proper posture during extended use. In addition, such known combined devices generally do not provide for an appropriate amount of air ventilation or circulation proximate both the lower back and coccyx of the user. As a result, such combined devices may provide relatively little relief from back pain resulting from being seated for extended periods of time or from sitting on relatively hard surfaces with poor posture. In addition, the poor ventilation characteristics of such devices may result in discomfort.

The various embodiments described in the present disclosure overcome one or more of the problems described above.

BRIEF SUMMARY OF THE INVENTION

In an exemplary embodiment of the present disclosure, a seating support includes a lumbar support portion having first and second lumbar supports. The lumbar support portion defines at least a portion of a channel extending between the first and second lumbar supports. The channel is sized to substantially preclude contact with an occupant of the seating support. The seating support also includes a coccyx support portion having first and second coccyx supports. The coccyx support portion is disposed substantially perpendicular to the lumbar support portion and is in communication therewith such that the channel extends from the lumbar support portion between the first and second coccyx supports.

In such an exemplary embodiment, a bottom surface of the coccyx support portion defines a plurality of coplanar support sections, and in such an embodiment, the bottom surface is substantially exposed and a bottom surface of the channel defines at least one of the plurality of support sections. In addition, at least one support section comprises a substantially linear portion of the bottom surface of the channel and the at least one support section comprises a substantially planar portion of the bottom surface of the channel.

In an additional exemplary embodiment, a bottom surface of the channel forms a first of the plurality of coplanar support sections at a front of the coccyx support portion, and a second of the plurality of coplanar support sections at a rear of the coccyx support portion. In such an exemplary embodiment, at least one of the first and second coplanar support sections is substantially linear. In addition, the bottom surface of the coccyx support portion forms a third and fourth of the plurality of coplanar support sections at the front of the coccyx support portion, the third and fourth coplanar support sections being disposed on opposite sides of the first coplanar support section. In such an exemplary embodiment, the bottom surface of the coccyx support portion forms a fifth and sixth of the plurality of coplanar support sections at the rear of the coccyx support portion, the fifth and sixth coplanar support sections being disposed on opposite sides of the second coplanar support section.

In a further exemplary embodiment, the coccyx support portion flexibly communicates with the lumbar support portion such that occupancy of the seating support causes the lumbar support to form an acute angle with the coccyx support portion. In additional exemplary embodiments, the lumbar support portion is formed integral with the coccyx support portion, and at least one of the first and second lumbar supports, and first and second coccyx supports is formed integral with the seating support. In additional exemplary embodiments, at least one of the first and second lumbar supports, and first and second coccyx supports is coupled to the seating support, and the first and second coccyx supports are disposed at respective concave regions of the coccyx support portion.

In another exemplary embodiment of the present disclosure, a seating support includes a lumbar support portion having a plurality of lumbar supports on a front surface thereof, and a coccyx support portion flexibly communicating with the lumbar support and disposed substantially perpendicular thereto when the seating support is unoccupied. The coccyx support portion includes a plurality of coccyx supports on a top surface thereof. The seating support also includes a channel extending at least partially through the lumbar and coccyx support sections along a central plane of the seating support.

In such an exemplary embodiment, a bottom surface of the coccyx support portion defines a plurality of coplanar support sections, and a substantially planar portion of a bottom surface of the channel forms at least one of the plurality of coplanar support sections.

In another exemplary embodiment, a method of forming a seating support includes forming a lumbar support portion integral with and substantially perpendicular to a coccyx support portion, forming a channel extending at least partially through the lumbar and coccyx support portions along a central plane of the seating support, and forming a plurality of coplanar support sections along a bottom surface of the coccyx support portion, at least one of the plurality of coplanar support sections being formed by a bottom surface of the channel.

In such an exemplary embodiment, the method further includes coupling a plurality of lumbar supports to the lumbar support portion and a plurality of coccyx supports to the coccyx support portion.

BRIEF DESCRIPTION OF THE SEVERAL VIEWS OF THE DRAWING(S)

DETAILED DESCRIPTION OF THE INVENTION

FIGS. 1-9 illustrate exemplary embodiments of a seating support 10. The exemplary embodiment illustrated in FIG. 8 shall be referred to throughout the present disclosure unless otherwise specified, and like item numbers have been used in the various figures to identify like components of the exemplary seating supports illustrated therein.

Figure 8:
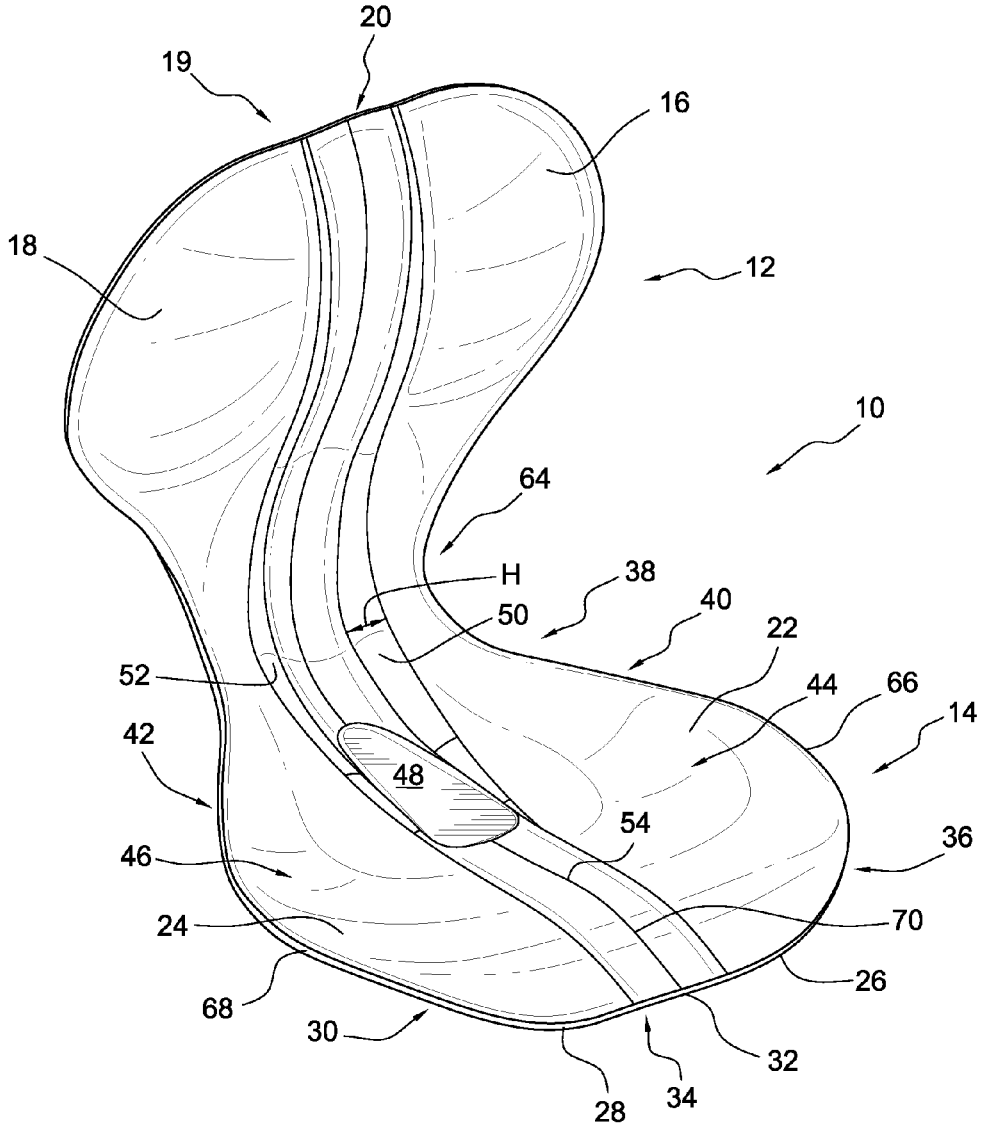
FIG. 8 illustrates a seating support according to yet another exemplary embodiment of the present disclosure.

As shown in FIG. 8, an exemplary seating support 10 may include a lumbar support portion 12, and a coccyx support portion 14 disposed substantially perpendicular to the lumbar support portion 12. The coccyx support portion 14 is connected to and/or otherwise in communication with the lumbar support portion 12, and in an exemplary embodiment, the coccyx support portion 14 may be formed integral with the lumbar support portion 12. In such an exemplary embodiment, the entire seating support 10 may be formed from a single piece of material through any known formation procedure. For example, the seating support 10 may be formed through any injection molding, thermoforming, extrusion, milling, machining, and/or other known manufacturing process. Accordingly, one or more portions of the seating support 10 may be formed from any material amenable to such processes. Such materials may include, for example, rubber, plastics, polymers, foams, acrylics, metals, alloys, and/or any known combinations or variations thereof.

In additional exemplary embodiments, the seating support 10 may be formed by coupling, connecting, and/or otherwise combining two or more separately formed components. For example, the coccyx support portion 14 may be formed separate from the lumbar support portion 12, and during manufacture, the two separate portions 14, 12 may be coupled, combined, and/or otherwise connected to form a completed seating support 10. The two separate portions may be connected together by any known process and/or by using any known connective structures. For example, such portions 14, 12 may be welded, molded, fused, and/or otherwise coupled without the use of additional connecting structures. Alternatively, such separate portions 14, 12 may be joined utilizing one or more hinges, support brackets, screws, bolts, springs, and/or other like components.

The lumbar support portion 12 may include a first lumbar support 16 and a second lumbar support 18. In additional embodiments, the lumbar support portion may include two or more such supports 16, 18. The first and second lumbar supports 16, 18 may be formed from and/or otherwise formed integrally with the lumbar support portion 12. Alternatively, the lumbar supports 16, 18 may be coupled, attached, adhered, and/or otherwise connected to the lumbar support portion 12 in any known way. In such an exemplary embodiment, one or more of the lumbar supports 16, 18 may comprise a closed or open cell foam material, a low to mid range durometer rubber, cloth, leather, and/or other like materials known and/or used for cushioning or support. Such materials may be substantially sponge-like and/or substantially collapsible. Alternatively, such materials may comprise a compressible honeycomb, mesh, corrugate, and/or other like structure configured to provide comfort and support to occupants of the seating support 10. For example, such materials may be configured to compress but not completely collapse, thereby comfortably supporting substantially the entire body weight of at least one occupant of the seating support 10 for an extended period of time. Such materials may include, for example, polyethylene, polystyrene, minicell, volara, neoprene, styrofoam, and/or other like materials.

Lumbar supports 16, 18 may have any known shape, size, and/or other configuration. For example, such lumbar supports 16, 18 may be shaped, sized, contoured, and/or otherwise configured to substantially match the shape, size, and/or contour of at least a portion of the lumbar support portion 12. In addition, such lumbar supports 16, 18 may have any desired thickness to impart desirable comfort and/or support characteristics to the lumbar support portion 12. Such lumbar supports 16, 18 may be, for example, between approximately ⅓" and approximately 1" thick. In addition, such lumbar supports 16, 18 may comprise a single layer, or more than one layer formed, overlayed, molded, adhered, and/or otherwise joined together.

The lumbar support portion 12 may have any shape, size, contour, and/or any other structural configuration known in the art. Such configurations may be useful in supporting, for example, the lower, mid, and/or upper back of an occupant of the seating support 10. For example, a top 19 of the lumbar support portion 12 may have any desired width so as to be configured to support the shoulders and/or upper back of such an occupant. The lumbar supports 16, 18 may also be substantially convex and/or substantially planar to assist in providing such support to an occupant. At least a portion of the lumbar support portion 12 may be curved, shaped, and/or contoured to improve and/or accentuate such cushioning, and/or support capabilities. The lumbar support portion 12 may taper and/or otherwise narrow toward a transition region 64 where the lumbar support portion 12 joins, meets, and/or otherwise communicates with the coccyx support portion 14.

As shown throughout the figures, the transition region 64 may have any shape, size, dimension, and/or other configuration to assist in flexibly yet substantially rigidly supporting the lumbar support portion 12 relative to the coccyx support portion 14. For example, the transition region 64 may have any width W convenient for providing adequate strength for such substantially rigid support. In addition, the transition region 64 may be substantially flexible so as to allow any desired degree of relative movement between the lumbar support portion 12 and the coccyx support portion 14 while the seating support 10 is occupied.

The transition region 64 may be configured such that the lumbar support portion 12 is maintained substantially perpendicular to the coccyx support portion 14 before, during, and/or after use. For example, the transition region 64 may be configured such that the lumbar support portion 12 is maintained at a slightly acute angle, such as between approximately 80° and approximately 90°, when the seating support 10 is not occupied. Upon occupancy, the weight of the occupant may cause the lumbar support portion 12 to pivot toward the coccyx support portion 14 by between approximately 1° and approximately 10°. In addition, an occupant may contact the lumbar support portion 12 during use, thereby causing the lumbar support portion 12 to flex and/or pivot away from the coccyx support portion 14 between approximately 1° and approximately 10°. In this way, exemplary transition regions 64 of the present disclosure may perform a hinge-like function allowing the lumbar support portion 12 and the coccyx support portion 14 to pivot and/or otherwise move with respect to each other. The transition region 64 may enable such flexibility while, at the same time, providing an adequate level of support to the occupant to reduce and/or otherwise eliminate back pain resulting from remaining in a seated position for extended periods of time. It is understood that transition regions 64 having a greater width W may be more rigid than transition regions 64 having a relatively smaller width W. In addition, at least the transition region 64 of the seating support 10 may be formed from any known shape memory material such that upon completion of use by the occupant, the lumbar support portion 10 may return to substantially its original position relative to the coccyx support portion 14.

The seating support 10 may also include at least one channel 20. In an exemplary embodiment, the channel 20 may be defined by at least a portion of the lumbar support 12 and/or the coccyx support portion 14. The channel 20 may have any shape, size, and/or other configuration known in the art. Such a channel 20 may assist in allowing ventilation beneath and/or behind an occupant when the seating support 10 is occupied. For example, the one or more channels 20 may define a path for air flow proximate the lower back, legs, buttocks, coccyx, and/or other regions of the occupant's body during use of the seating support 10, and such air flow may reduce and/or otherwise eliminate the buildup of moisture and/or other uncomfortable conditions during use.

The channel 20 may also assist in providing strength, rigidity, and/or any desired degree of flexibility to the seating support 10. For example, the channel 20 may assist in strengthening the transition region 64. Such added strength and/or rigidity may enable the seating support 10 to provide an adequate level of support to occupants while, for example, minimizing the width W of the transition region 64 and/or any of the other dimensions of portions of the seating support 10. The shape, size, dimensions, and/or other configurations of the channel 20 may be chosen to impart any desirable strength, rigidity, flexibility, and/or other properties to one or more portions of the seating support 10. For example, a cross-section of the channel 20 may be substantially curved, thereby defining any desired radius r known in the art. Moreover, as the seating support 10 includes one or more contours, so to may the channel 20, and each such contour may have a unique radius r.

In additional exemplary embodiments, the radius r may not be constant along the entire length of the channel 20. For instance, it may be desired to increase the radius r proximate the transition region 64 to augment the rigidity of the seating support 10 in that region 64. Further, the channel 20 may define a base 54 extending the length of the channel 20. In an exemplary embodiment, the radius r may be formed along only a portion of the base 54. Alternatively, one or more radius r may be formed along the entire length of the base 54. In such exemplary embodiments, however, the radius r may be substantially constant or may vary in dimension at different locations along the base 54.

In additional exemplary embodiments, the channel 20 may include one or more substantially linear and/or substantially planar portions. Such portions may have any shape, size, dimension, and/or other configuration known in the art. For example, the channel 20 may define one or more sidewalls 50, 52 (FIG. 8) extending along at least a portion of the channel 20. In an exemplary embodiment, at least one of the sidewalls 50 may intersect with the base 54 along a length of the channel 20. The sidewalls 50, 52 may be disposed substantially perpendicular to the base 54. Alternatively, one or more of the sidewalls 50, 52 may be disposed at any known acute or acute angle relative to the base 54. As described above with regard to the radius r, one or more portions of the channel 20 may be tapered, and in such exemplary embodiments, at least one of the sidewalls 50, 52 may include such a taper. Such tapered portions of the channel 20 may impart any desired support and/or comfort characteristics to the seating support 10.

In exemplary embodiments, the channel 20 may be sized, shaped, and/or otherwise configured to substantially preclude contact with an occupant with the seating support 10 during use. For example, the radius r and/or height H of the sidewalls 50, 52 may be sized to define a channel 20 having an appropriate depth to avoid such contact. Accordingly, the exemplary channels 20 described herein may be deep enough such that even when the seating support 10 is occupied, the occupant may be substantially completely supported by, for example, upper surfaces of the coccyx support portion 14 and/or the lumbar support portion 12. In this way, the occupant may be seated and/or otherwise supported above and/or outside of the channel 20, and the occupant may not come into contact with the base 54 and/or other components of the channel 20 during use. Sizing, shaping, and/or otherwise configuring the channel 20 to substantially preclude contact with occupants of the seating support 10 may assist the channel 20 in performing, for example, its ventilation, structural rigidity, and/or other functions. Such an exemplary channel 20 may be formed by the lumbar support portion 12 and/or coccyx support portion 14 so as to extend from the lumbar support portion 12 through at least a portion of, and/or substantially the entire coccyx support portion 14. Such a channel 20 may be formed by any known manufacturing processes such as, for example, cutting, etching, molding, thermo-forming, bending, extruding, and/or any of the other processes described above with regard to forming the seating support 10. Moreover, the sidewalls 50, 52, base 54, and/or various other seating support components described herein may also be formed by such manufacturing processes.

As shown in at least FIG. 8, the channel 20 may define one or more flats 48. At least one of the flats 48 may be formed by the base 54, and such a flat 48 may be disposed proximate the transition region 64. In an exemplary embodiment, at least one flat 48 may assist in supporting the seating support 10 in a substantially upright position as shown in FIG. 8 and before, during, and/or after use. For example, an underside of such a flat 48, formed by a bottom surface 30 of the coccyx support portion 14 may act as a support section for the seating support 10. Such a support section formed by the bottom surface 30 of the coccyx support portion 14 at the underside of the flat 48 may provide stability to the seating support 10 when the seating support 10 is disposed a substantially flat and/or substantially horizontal surface such as, for example, a bleacher seat or on the ground.

The seating support 10 may include one or more such support sections configured to assist in maintaining the seating support 10 in such an upright position before, during, and/or after use, and at least one of the plurality of support sections may be formed by the bottom surface 30 of the coccyx support portion 14. For example, as shown in FIG. 8, the bottom surface 30 of the coccyx support portion 14 may define at least a portion of a bottom surface 34 of the channel 20. The bottom surface 34 of the channel 20 may form at least one support section 32 at a front 36 of the coccyx support portion 14. Such a support section 32 may be substantially curved, substantially tapered, substantially linear, substantially flat, substantially planar, and/or any other known shape or size configured to assist in stabilizing the seating support 10. In an exemplary embodiment, the support section 32 may be collinear and/or coplanar with, for example, the support section formed by the bottom surface 30 at the flat 48.

The seating support 10 may define any number of support sections necessary for stability. For example, additional support sections 26, 28 may be formed by the bottom surface 30 of the coccyx support portion 14 at the front 36 of the coccyx support portion 14. Such support sections 26, 28 may be substantially collinear and/or substantially coplanar with at least one of the support sections described above. As shown in FIG. 8, the support section 26 may be disposed on a first side of the channel 20, and the support section 28 may be disposed on a second side of the channel 20 opposite the first side of the channel 20. Due to their respective locations on either side of the channel 20, the support sections 26, 28 may assist in stabilizing the seating support 10 against, for example, rotation in the clockwise and/or counterclockwise direction during use.

The seating support 10 may also include one or more analogous support sections disposed proximate the transition region 64 such as, for example, at a rear 38 of the coccyx support portion 14. For example, the seating support 10 may include a support section 40 formed by the bottom surface 30 on the same side of the channel 20 as the support section 26. The seating support 10 may also define an additional support section 42 formed by the bottom surface 30. The support section 42 may be disposed opposite the support portion 40 on the same side of channel 20 as the support section 28.

As described above, each of the support sections described herein may assist in preventing clockwise and/or counterclockwise rotation of the seating support 10, and may also be configured to assist in supporting and/or stabilizing substantially the entire seated weight of an occupant during use. As described above, one or more of the support sections described above may be formed by the bottom surface 30, and one or more such support sections may be substantially linear, substantially curved, substantially tapered, substantially planar, and/or any other configuration known in the art. In addition, any of the above support sections may be coplanar with respect to one another. In still further exemplary embodiments, one or more feet, grommets, dampers, grips, knobs, wheels, and/or other like structures may be connected to the bottom surface 30 of the coccyx support portion 14, and such structures may perform one or more of the functions described herein with regard to the above support sections.

As described above, the seating support 10 may include a coccyx support portion 14 in flexible communication with the lumbar support portion 12. The coccyx support portion 14 may include one or more concave regions 44, 46 configured to support an occupant of the seating support 10. In particular, the concave region 44 may be disposed on a first side of the channel 20, and the concave region 46 may be disposed on a second side of the channel 20 opposite the concave region 44. The concave regions 44, 46 may be configured to support, for example, the buttocks, coccyx, and/or rear leg regions of the occupant while seated on the seating support 10. The concave regions 44, 46 may be, for example, substantially bowl-shaped, and may have any radius suitable for such support.

In an exemplary embodiment, side edges 66, 68 of the coccyx support portion 14 may be tapered, angled, and/or otherwise configured to maximize support and/or comfort of the user. For example, as shown in FIG. 8, the side edges 66, 68 may be curved in a downward direction so as to avoid discomfort to the user that could potentially result from, for example, a portion of the coccyx support portion 14 impacting the buttocks, leg, or thigh of an occupant. In additional exemplary embodiments, the side edges 66, 68 may not be tapered, and in further exemplary embodiments, such side edges 66, 68 may be curved, angled, and/or otherwise tapered in an upward direction to assist in supporting an occupant of the seating support 10. In addition, the front 36 of the coccyx support portion 14 may have a similar taper, curve, and/or other configuration to the side edges 66, 68 described herein.

Figure 1:
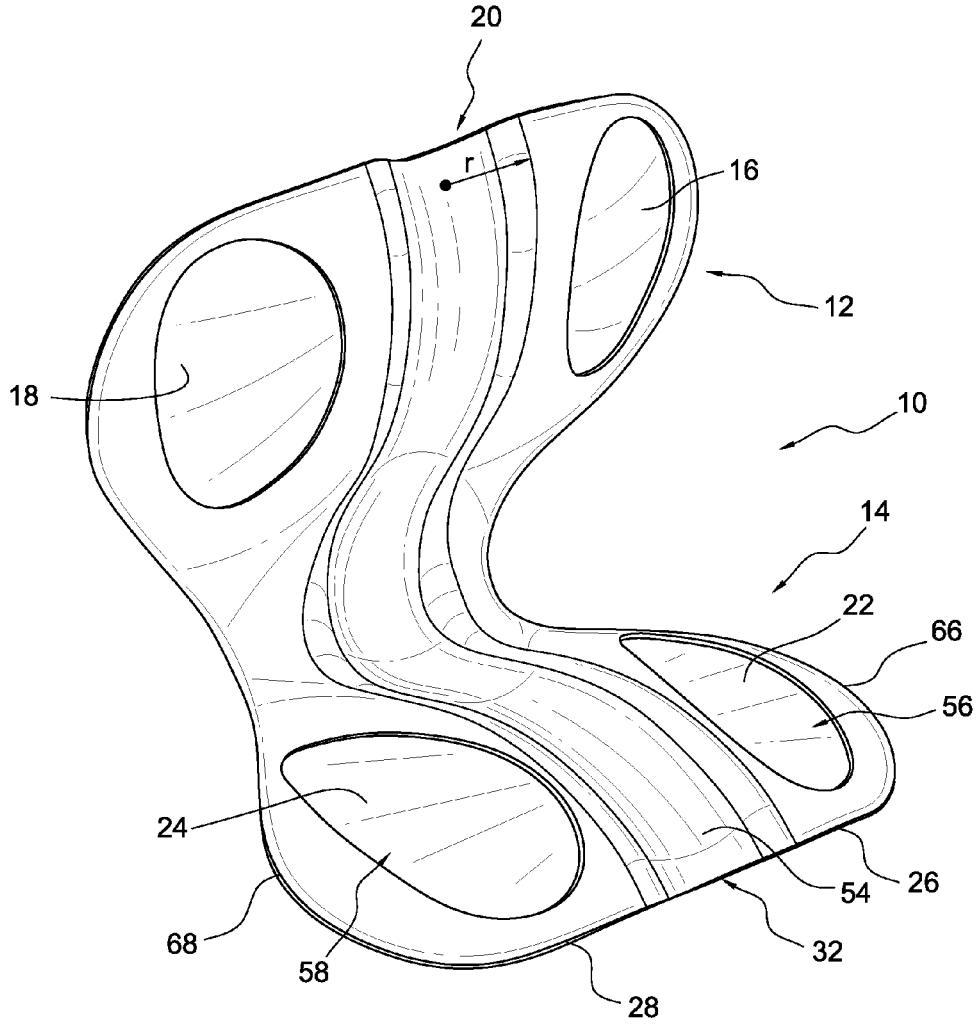
FIG. 1 illustrates a seating support according to an exemplary embodiment of the present disclosure.
Figure 2:
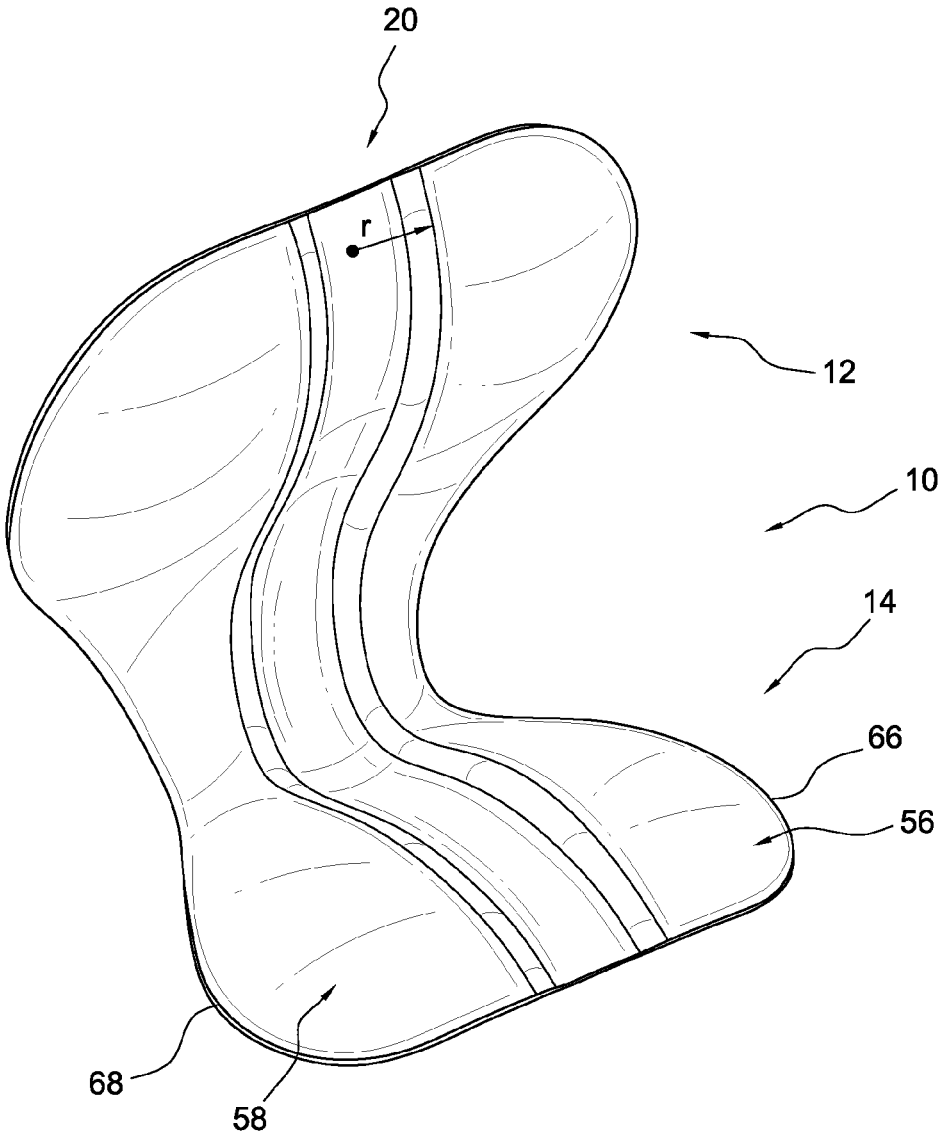
FIG. 2 illustrates a seating support according to another exemplary embodiment of the present disclosure.
Figure 3:
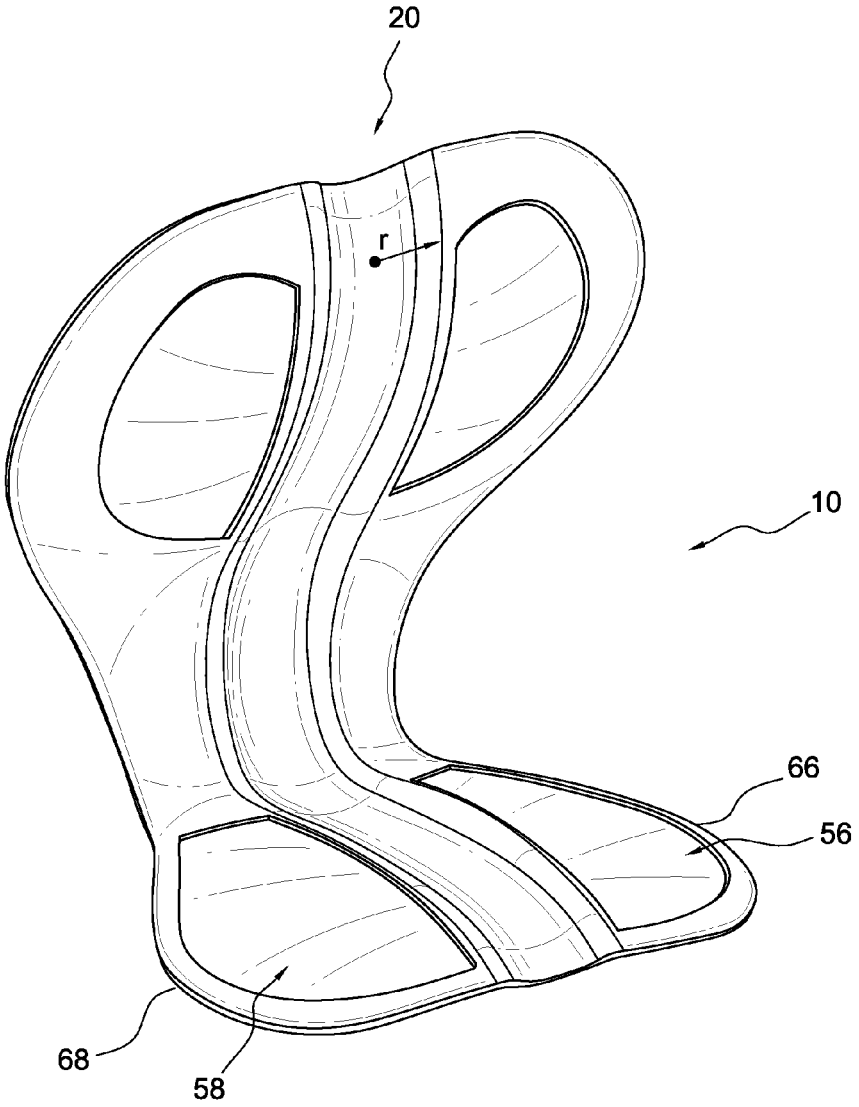
FIG. 3 illustrates a seating support according to still another exemplary embodiment of the present disclosure.
Figure 4:
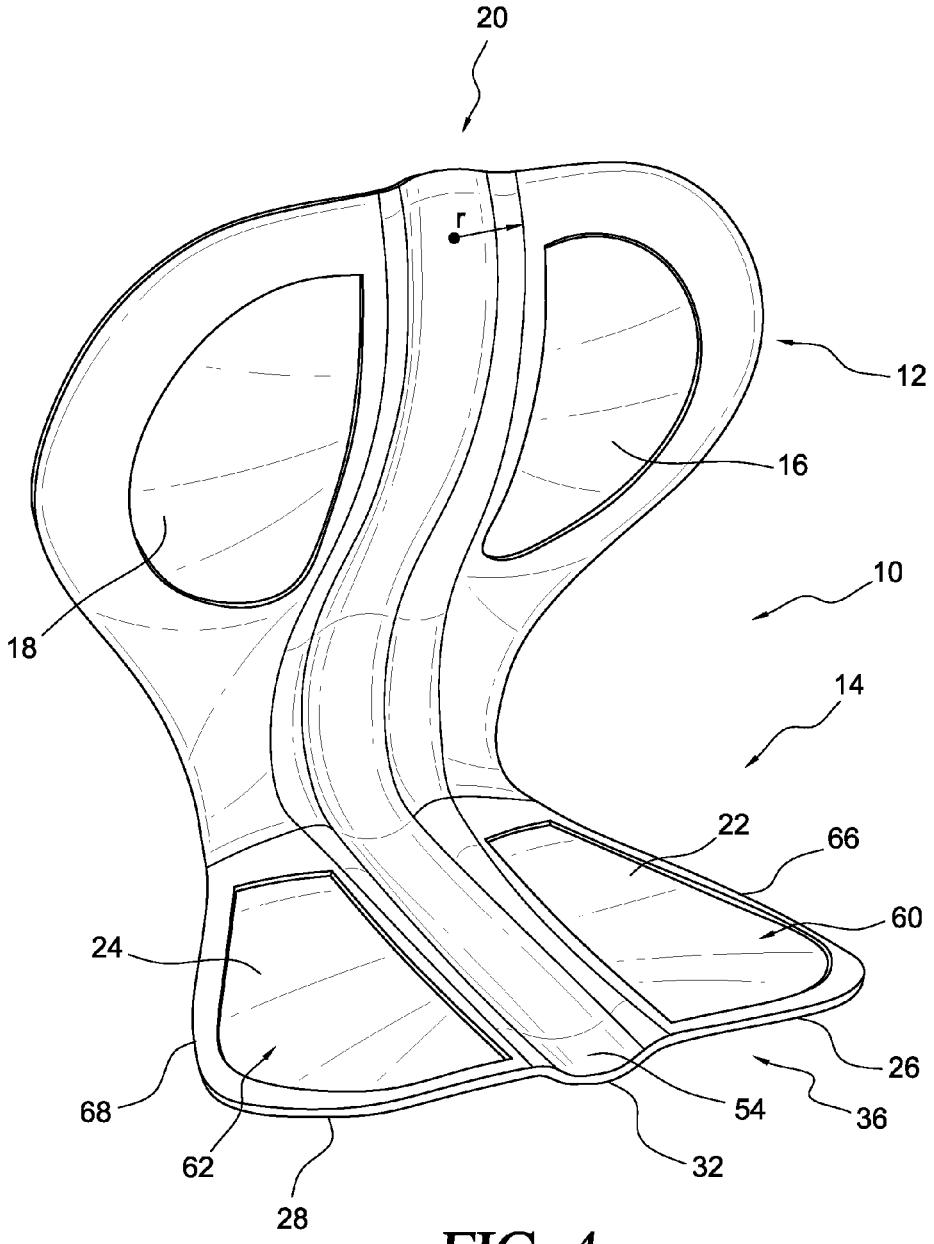
FIG. 4 illustrates a seating support according to a further exemplary embodiment of the present disclosure.
Figure 5:
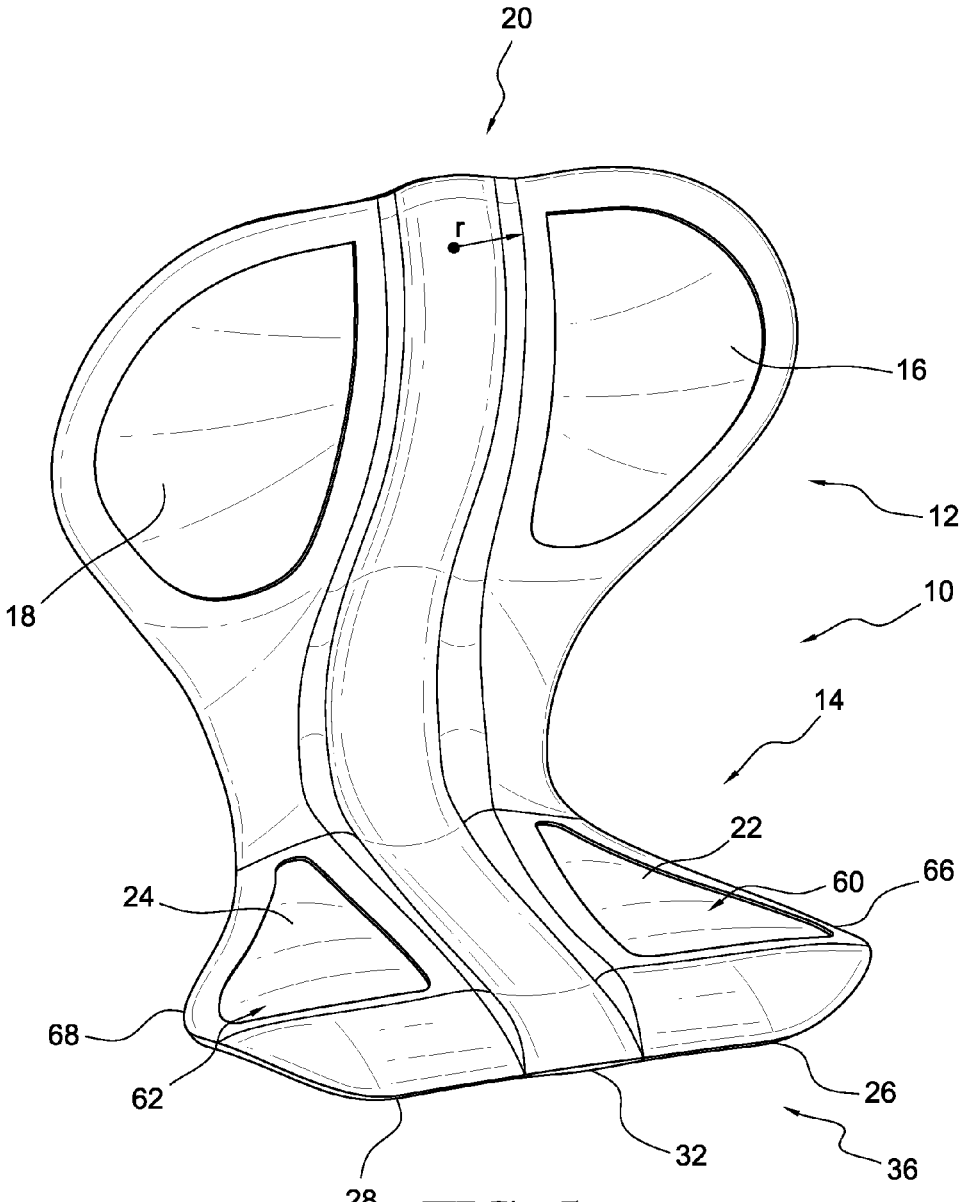
FIG. 5 illustrates a seating support according to another exemplary embodiment of the present disclosure.
Figure 6:
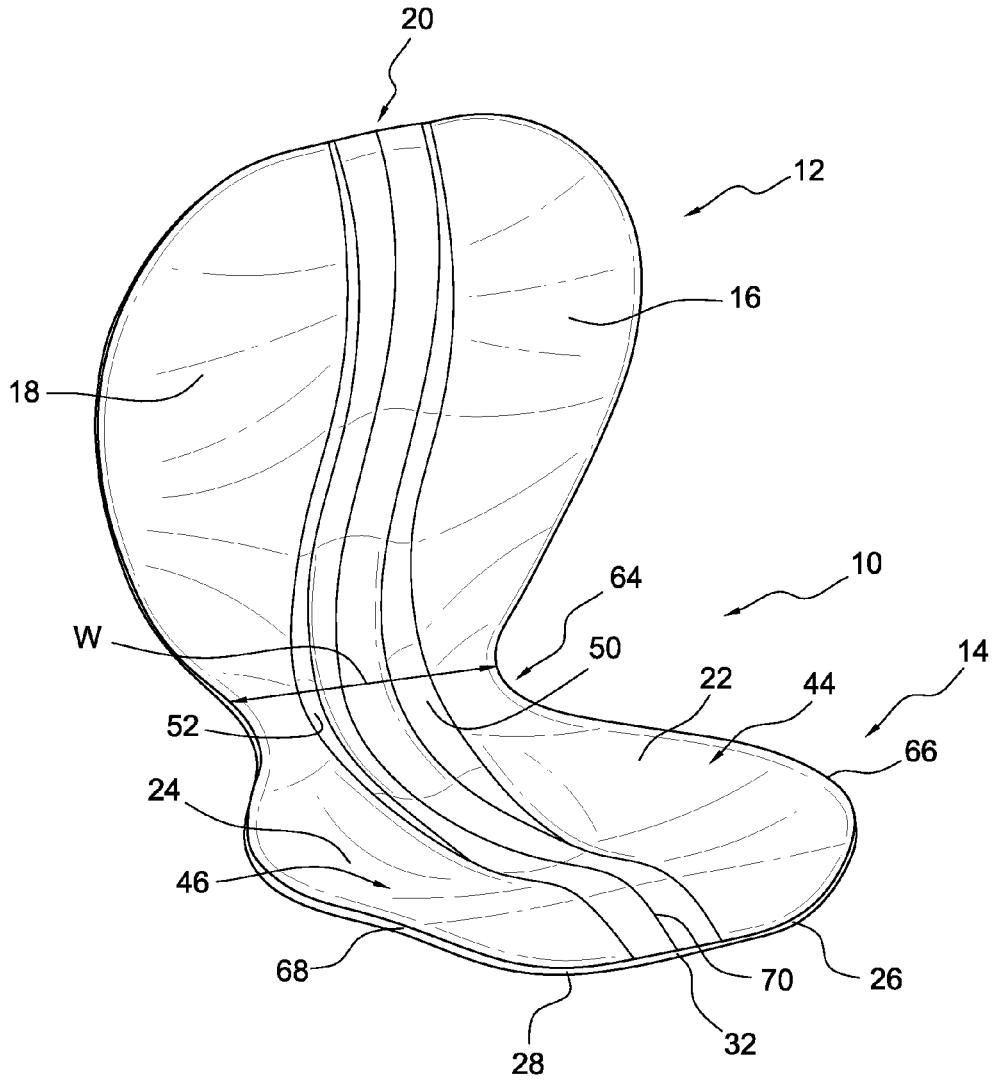
FIG. 6 illustrates a seating support according to a further exemplary embodiment of the present disclosure.
Figure 7:
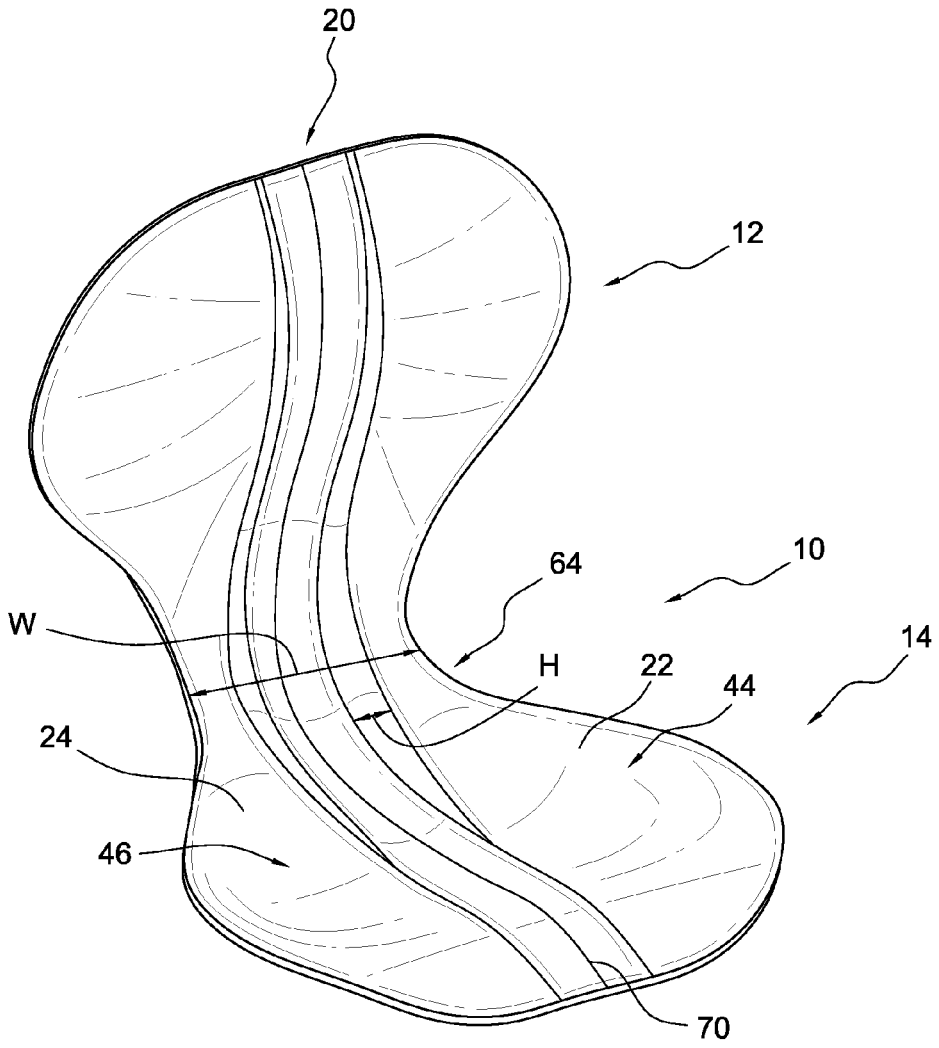
FIG. 7 illustrates a seating support according to still another exemplary embodiment of the present disclosure.

In further exemplary embodiments, the side edges 66, 68 may generally follow the shape, contour, taper, and/or other configuration of the respective region of the coccyx support portion 14 to which the edges 66, 68 are adjacent. For example, exemplary embodiments of the coccyx support portion 14 may include substantially planar regions instead of concave regions 44, 46. Such exemplary planar regions 60, 62 of the coccyx support portion 14 are illustrated in, for example, FIGS. 4 and 5. In such exemplary embodiments, the side edges 66, 68 may be substantially coplanar with their corresponding respective planar regions 60, 62. Alternatively, the coccyx support portion 14 may include one or more convex regions. Such exemplary convex regions 56, 58 are illustrated in FIGS. 1-3. In such exemplary embodiments, the side edges 66, 68 may substantially follow the angle, shape, taper, contour, and/or other configurations of the corresponding convex regions 56, 58.

The planar regions 60, 62 and convex regions 56, 58 may be configured to provide support and to enhance the comfort of occupants of the seating support 10 in ways substantially similar to those described above with respect to the concave regions 44, 46. In additional exemplary embodiments, such regions of the coccyx support portion 14 may comprise one or more coccyx supports 22, 24. Such coccyx supports 22, 24 may be substantially similar to the lumbar supports 16, 18 described above with regard to the lumbar support portion 12. For example, such coccyx supports 22, 24 may be formed integral with the coccyx support portion 14. Alternatively, such coccyx supports 22, 24 may be connected, attached, adhered, and/or otherwise coupled to the coccyx support portion 14 in any known way.

Any of the materials described above with regard to the lumbar supports 16, 18 may be utilized to form such coccyx supports 22, 24, and the coccyx supports 22, 24 may substantially conform to the region of the coccyx support portion 14 at which the coccyx supports 22, 24 are disposed. For example, coccyx supports 22, 24 disposed at concave regions 44, 46 of the coccyx support portion 14 may be substantially concave to match the shape, angle, contour, and/or other configurations of the corresponding concave regions 44, 46. Likewise, coccyx supports 22, 24 disposed at convex regions 56, 58 or substantially planar regions 60, 62 may have tapers, curves, contours, and/or other configurations substantially matching such corresponding regions.

Figure 9:
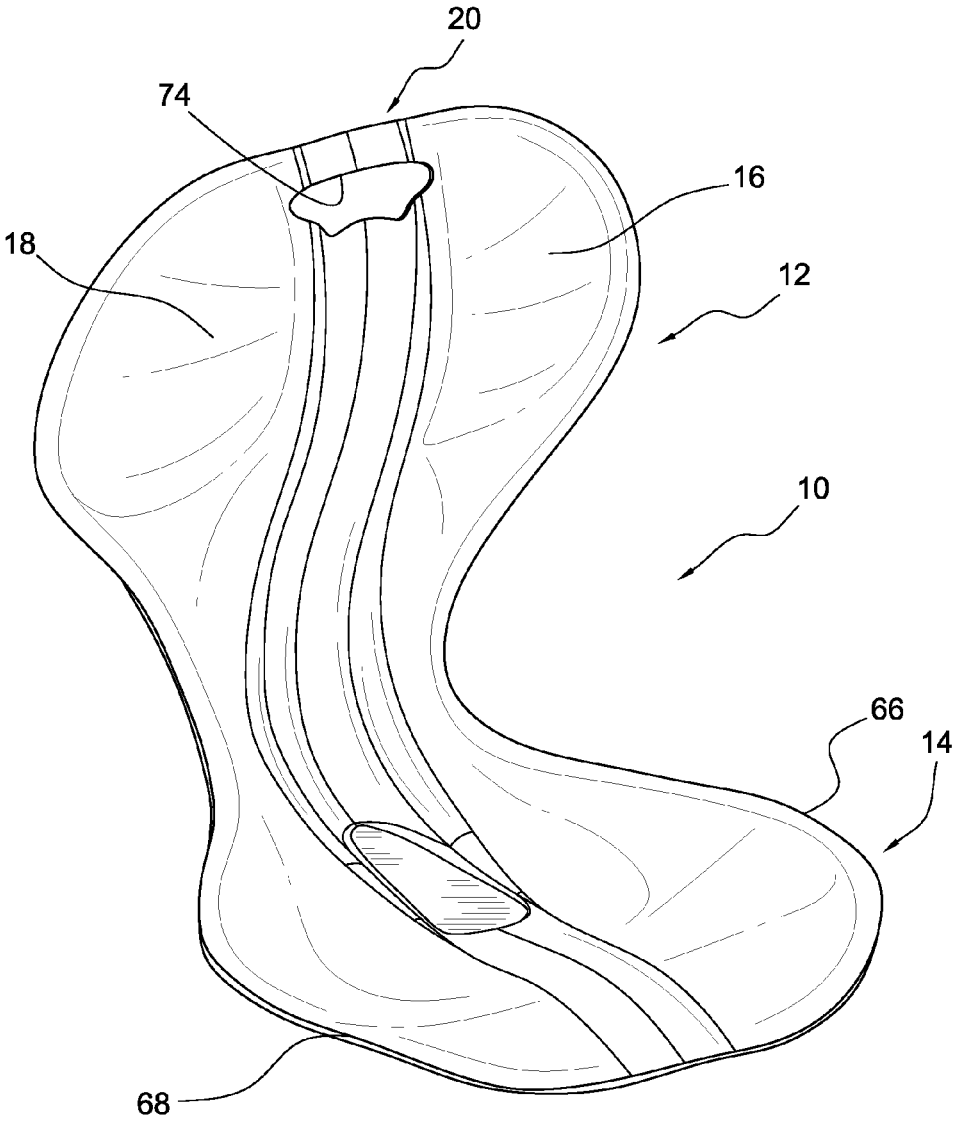
FIG. 9 illustrates a seating support according to a further exemplary embodiment of the present disclosure.

In additional exemplary embodiments, the seating support 10 may include one or more handles to assist the user in, for example, positioning and/or transporting the seating support 10. As illustrated in FIG. 9, such an exemplary handle 74 may be formed by, for example, etching, cutting, and/or otherwise removing a portion of the seating support 10. For example, such a handle 74 may be formed integrally with the lumbar support portion 12 by removing at least a portion of the channel 20 and/or portions of either of the lumbar supports 16, 18. In an additional exemplary embodiment, the handle 74 may be formed through any of the extrusion, molding, and/or other processes described herein, and in such exemplary embodiments, it may not be required to remove portions of the seating support 10 to form the handle 74.

In still further exemplary embodiments, one or more handles 74 may be located at other portions of the seating support 10. For example, it may be desirable to include at least one handle in the coccyx support portion 14, and such handles may be, for example, located proximate the side edges 66, 68 described above so as to minimize interference with the comfort and/or support functions of the coccyx support portion 14. In still further exemplary embodiments, such handles 74 may comprise indentations, extensions, and/or other like structures defined by the various portions of the seating support 10. In such exemplary embodiments, no material may be removed from the seating support 10 in order to form the handles 74. Instead, such handles 74 may be formed by the various portions of the seating support 10 by any of the processes described herein.

During use, the seating support 10 may be disposed on any substantially flat and/or substantially horizontal surface such as, for example, a grassy area of a lawn or sideline, a bleacher seat, a park bench, and/or other chairs or chair-like structures. When so disposed, the one or more support sections described herein may assist in stabilizing and/or otherwise supporting the seating support 10, and maintaining the seating support 10 in the substantially upright position shown in FIGS. 1-8. Such support sections may contact the surface on which the seating support 10 is disposed in order to maintain such support, and at least one of the support sections may contact such a surface prior to occupancy of the seating support 10. Such support sections may be configured to accept substantially vertical, horizontal, and/or rotational forces applied thereto by an occupant during use of the seating support 10.

While the seating support 10 is unoccupied, the coccyx support portion 14 may be disposed at an acute angle to the lumbar support portion 12. Once appropriately positioned on a suitable surface, a user may occupy the seating support 10 by sitting on the coccyx support portion 14. Such a user may also rest at least a portion of his/her back on the lumbar support portion 12. Contact with the various components and/or regions of the lumbar and coccyx support portions 12, 14 may comfortably support the occupant during use of the seating support 10 for extended periods of time. In addition, the coccyx supports 22, 24 and lumbar supports 16, 18 may provide suitable resistance to the occupant during use, thereby supporting various regions of the occupant's body and reducing and/or otherwise eliminating pain and discomfort associated with extended periods of sitting. The channel 20 may assist in providing such resistance and the transition region 64 may assist the lumbar support portion 12 and the coccyx support portion 14 in springedly flexing and/or otherwise bending relative to each other during occupancy. For example, the channel 20 may extend at least partially through the lumbar and coccyx support portions 12, 14 along a central plane of the seating support 10. The channel 20 and/or the transition region 64 may allow for the coccyx support portion 14 to flexibly communicate with the lumbar support portion 12 such that occupancy of the seating support 10 causes the lumbar support 16 to form an acute angle with the coccyx support portion 14. It is understood that such an acute angle may be less than the acute angle formed between the lumbar support 16 and the coccyx support portion 14 when the seating support 10 is unoccupied. The central plane is at least partially illustrated in FIGS. 6-8 by item 70.

The invention has been described in detail with particular reference to a presently preferred embodiment, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

The invention claimed is:

1. A seating support, comprising:

(a) a lumbar support portion having first and second lumbar supports, the lumbar support portion defining at least a portion of a channel extending between the entire first and the entire second lumbar supports, the lumbar support portion comprising a space defining a hollow center proximate a top edge of the seating support within the channel and between the first and second lumbar supports, wherein the space is a handle, wherein the handle is formed integrally with the lumbar support portion by removing at least a portion of the channel and a portion of the first and second lumbar supports;

(b) a coccyx support portion having first and second coccyx supports, the coccyx support portion disposed substantially perpendicular to the lumbar support portion and in communication therewith such that the channel extends from the lumbar support portion between the entire first and the entire second coccyx supports; and (c) a transition region intermediate the lumbar support portion and the coccyx support portion, the transition region substantially preventing rotation of the lumbar support portion relative to the coccyx support portion independent of a secondary seat without any external reinforcement for the lumbar support portion (i) in a direction of rotation increasing an angle between the lumbar support portion and the coccyx support portion and (ii) in a direction of rotation decreasing the angle between the lumbar support portion and the coccyx support portion, the transition region maintaining the coccyx support portion substantially perpendicular to the lumbar support portion, the lumbar support portion, the coccyx support portion, the channel, and the transition region being an integral one piece construction, and the channel defining a curved section comprising at least one flat portion disposed proximate the transition region on the coccyx support portion, the at least one flat portion supporting the seating support in a substantially upright position.

2. The assembly of claim 1, wherein a bottom surface of the coccyx support portion defines a plurality of coplanar support sections.

3. The assembly of claim 2, wherein the bottom surface is substantially exposed.

4. The assembly of claim 2, wherein a bottom surface of the channel defines at least one of the plurality of coplanar support sections.

5. The assembly of claim 4, wherein the at least one support section comprises a substantially linear portion of the bottom surface of the channel.

6. The assembly of claim 4, wherein the at least one support section comprises a substantially planar portion of the bottom surface of the channel.

7. The assembly of claim 2, wherein the channel is between two of the plurality of coplanar support sections.

8. The assembly of claim 2, wherein at least one of the plurality of coplanar support sections is located in the channel.

9. The assembly of claim 2, wherein at least two of the plurality of coplanar support sections resist rotation of the seating support during use.

10. The assembly of claim 1, further comprising a pair of convex regions in the coccyx support portion, the channel extending between the convex regions.

11. The assembly of claim 1, wherein the coccyx support portion springedly flexes relative to the lumbar support portion through the transition region such that occupancy of the seating support causes the lumbar support to form an acute angle with the coccyx support portion.

12. The assembly of claim 1, wherein at least one of the first and second lumbar supports, and first and second coccyx supports is formed integral with the seating support.

13. The assembly of claim 1, wherein at least one of the first and second lumbar supports, and first and second coccyx supports is coupled to the seating support.

14. The assembly of claim 1, wherein the first and second coccyx supports are disposed at respective concave regions of the coccyx support portion.

15. A seating support, comprising:

(a) a lumbar support portion having a plurality of lumbar supports on a front surface thereof, wherein the plurality of lumbar supports comprise a material different from the lumbar support portion, the lumbar support portion comprising a space defining a hollow center proximate a top edge of the seating support, wherein the space is a handle, wherein the handle is formed integrally with the lumbar support portion by removing at least a portion of the channel and portions of the first and second lumbar supports;

(b) a coccyx support portion disposed substantially perpendicular thereto when the seating support is unoccupied, the coccyx support portion having a plurality of coccyx supports on a top surface thereof, wherein the plurality of coccyx supports comprise a material different from the coccyx support portion;

(c) a transition region interconnecting the lumbar support portion and the coccyx support portion, the transition region substantially preventing rotation of the lumbar support portion relative to the coccyx support portion independent of a secondary seat without any external reinforcement for the lumbar support portion (i) in a direction of rotation increasing an angle between the lumbar support portion and the coccyx support portion and (ii) in a direction of rotation decreasing the angle between the lumbar support portion and the coccyx support portion, the transition region maintaining the coccyx support portion substantially perpendicular to the lumbar support portion, and and retaining the lumbar support portion substantially perpendicular to the coccyx support portion independent of a secondary seat when the seating support is occupied and retaining the lumbar support portion substantially perpendicular to the coccyx support portion when the seating support is unoccupied, the lumbar support portion, the coccyx support portion, the channel and the transition region being one piece integral construction; and (d) a channel extending completely through the lumbar and coccyx support sections along a central plane of the seating support, the channel defining a curved section comprising at least one flat portion disposed proximate the transition region on the coccyx support portion, the at least one flat portion supporting the seating support in a substantially upright position, wherein the coccyx support portion springedly flexes relative to the lumbar support portion through the transition region such that occupancy of the seating support causes the lumbar support to form an acute angle with the coccyx support portion.

16. The seating support of claim 15, wherein a bottom surface of the coccyx support portion defines a plurality of coplanar support sections, the support sections retaining the seating support in an upright self-supporting position.

17. The seating support assembly of claim 16, wherein a substantially planar portion of a bottom surface of the channel forms at least one of the plurality of coplanar support sections.

18. A method of forming a seating support, comprising:

(a) forming an integral lumbar support portion, transition region and coccyx support portion, the transition region locating the lumbar support portion substantially perpendicular to the coccyx support portion, the lumbar support portion comprising a space defining a hollow center proximate a top edge of the seating support, wherein the space is a handle, wherein the handle is formed integrally with the lumbar support portion by removing at least a portion of the channel and portions of the first and second lumbar supports;

(b) forming a channel extending completely through the lumbar and coccyx support portions along a central plane of the seating support, the channel defining a curved section comprising at least one flat portion disposed proximate the transition region on the coccyx support portion, the at least one flat portion supporting the seating support in a substantially upright position; and (c) the lumbar support portion, the transition region substantially preventing rotation of the lumbar support portion relative to the coccyx support portion independent of a secondary seat without any external reinforcement for the lumbar support portion (i) in a direction of rotation increasing an angle between the lumbar support portion and the coccyx support portion and (ii) in a direction of rotation decreasing the angle between the lumbar support portion and the coccyx support portion, the transition region maintaining the coccyx support portion substantially perpendicular to the lumbar support portion when not in use, and wherein transition region, the channel and coccyx support portion being one piece integral construction and forming an acute angle between the lumbar support portion and the coccyx support portion, the transition region precluding rotation of the lumbar support portion relative to the coccyx support portion of substantially more than 10° during intended use, independent of a secondary seat, wherein the coccyx support portion springedly flexes relative to the lumbar support portion through the transition region such that occupancy of the seating support causes the lumbar support to form an acute angle with the coccyx support portion.

19. The method of claim 18, further comprising forming at least one planar support section on a bottom surface of the coccyx support portion.

* * * * *